US008840264B2

(12) United States Patent
Molina et al.

(10) Patent No.: US 8,840,264 B2
(45) Date of Patent: Sep. 23, 2014

(54) PORTABLE WORK LIGHT CLAMP

(75) Inventors: Francisco Molina, Davie, FL (US); Glenn Robinson, Coral Springs, FL (US)

(73) Assignee: IBT Holdings, LLC, Deerfield Beach, FL (US)

( * ) Notice: Subject to any disclaimer, the term of this patent is extended or adjusted under 35 U.S.C. 154(b) by 419 days.

(21) Appl. No.: 12/849,628

(22) Filed: Aug. 3, 2010

(65) Prior Publication Data

US 2012/0033412 A1 Feb. 9, 2012

(51) Int. Cl.

| | |
|---|---|
| ***F21L 4/00*** | (2006.01) |
| ***F21V 21/088*** | (2006.01) |
| *F21L 14/02* | (2006.01) |
| *F21V 21/30* | (2006.01) |
| *F21V 21/28* | (2006.01) |

(52) U.S. Cl.

CPC ..... *F21V 21/088* (2013.01); *F21L 14/02* (2013.01); *F21V 21/30* (2013.01); *F21V 21/28* (2013.01)

USPC ..... 362/191; 362/197; 362/199; 362/190; 362/396; 362/399; 362/287; 362/109; 362/427

(58) Field of Classification Search

CPC ..... F21L 14/02; F21V 21/088; F21V 21/28; F21V 21/30

USPC ..... 362/190, 191, 197, 199, 396, 399, 109, 362/287, 427

See application file for complete search history.

(56) References Cited

U.S. PATENT DOCUMENTS

| | | | | |
|---|---|---|---|---|
| 2,636,112 | A * | 4/1953 | Frank | 362/413 |
| 5,448,463 | A * | 9/1995 | Leen | 362/396 |
| D473,776 | S | 4/2003 | Hopper et al. | |
| 6,585,400 | B2 * | 7/2003 | Leen | 362/418 |
| 6,592,241 | B1 * | 7/2003 | Kovacik et al. | 362/419 |
| 6,711,789 | B2 * | 3/2004 | Ping | 24/505 |
| 6,860,179 | B2 | 3/2005 | Hopper et al. | |
| 6,862,961 | B2 | 3/2005 | Winkler | |
| 6,973,859 | B2 | 12/2005 | Noniewicz | |
| 7,040,783 | B1 * | 5/2006 | Christianson | 362/396 |
| 7,107,881 | B1 | 9/2006 | Liou | |
| 7,309,137 | B2 * | 12/2007 | Chan | 362/184 |
| 7,406,897 | B2 | 8/2008 | Hsu | |
| 7,572,024 | B2 * | 8/2009 | Ko et al. | 362/92 |
| 7,850,329 | B2 * | 12/2010 | Henry et al. | 362/191 |
| 8,025,420 | B2 * | 9/2011 | Henry et al. | 362/191 |
| 8,083,555 | B2 * | 12/2011 | Schouten | 439/822 |
| 8,348,454 | B2 * | 1/2013 | Henry et al. | 362/199 |
| 2010/0238653 | A1 * | 9/2010 | Pelletier et al. | 362/191 |

* cited by examiner

*Primary Examiner* — Thomas Sember
*Assistant Examiner* — Tsion Tumebo
(74) *Attorney, Agent, or Firm* — Steven M. Greenberg; CRGO Law

(57) ABSTRACT

A portable work light clamp system includes a first clamp handle assembly having a proximal end, a mid section and a distal end and a gripping/standing member rotatably coupled to the proximal end of the first clamp handle assembly, a second clamp handle assembly having a proximal end and a distal end and a gripping/standing member rotatably coupled to the proximal end of the second clamp handle assembly, a light assembly coupled to the distal end of the first clamp handle assembly that includes a swivel base member and a light housing pivotally coupled to the swivel base member by a light pivot to selectively pivot 50 degrees about a longitudinal axis of the light pivot and a light base coupled to the swivel base member and rotatable relative to the light base by a swivel connector to selectively rotate 360 degrees around a longitudinal axis of the light base.

7 Claims, 5 Drawing Sheets

PORTABLE WORK LIGHT CLAMP

BACKGROUND OF THE INVENTION

1. Field of the Invention

The disclosure relates generally to work lights and, more specifically, to rotatable and adjustable work lights that can be clamped to, mounted to or placed on a surface.

2. Description of the Related Art

Handheld lights are common tools found in the everyday toolbox. However, many times an individual user of a handheld light may need to operate another tool in the space illuminated by a handheld light. Small portable lamp assemblies, especially those that employ quartz halogen lamps, are especially well suited for home use as well as for professional use that includes automotive repair shops, construction and excavation sites, photography studios and in various situations where a portable light source is required to illuminate specific objects and areas.

Most portable lamp assemblies are equipped with either a handle for carrying or are mounted on a stand for stationary, long-term positioning. These lamps are most often connected to a standard 120 volt a-c receptacle by way of an electrical power cord. Despite their relative ease of use, the prior art lamps are often not designed to be selectively and easily positioned and secured for more unique or specialized applications. There is, therefore, a need for a rotatable and adjustable work light system that can be clamped to, mounted to or placed on a surface.

BRIEF SUMMARY OF THE INVENTION

A portable work light clamp system includes a first clamp handle assembly having a proximal end, a mid section and a distal end and a gripping member rotatably coupled to the proximal end of the first clamp handle assembly. The work light clamp system further includes a second clamp handle assembly having a proximal end and a distal end and a gripping member rotatably coupled to the proximal end of the second clamp handle assembly. The first clamp handle assembly and the second clamp handle assembly pivotally connected by a clamp pivot for pivotal opposed operation. A light assembly is coupled to the distal end of the first clamp handle assembly. The light assembly includes a swivel base member and a light housing pivotally coupled to the swivel base member by a light pivot that enables the light housing to selectively pivot 50 degrees about a longitudinal axis of the light pivot. The light assembly further includes a light base coupled to the swivel base member and rotatable relative to the light base by a swivel connector that enables the swivel base member to selectively rotate 360 degrees around a longitudinal axis of the light base. The work light clamp further can include a slotted extension member having a length that is coupled to the distal end of the first clamp handle assembly and coupled to a light base by a connector that enables the light base member to slidably extend along the length of the slotted extension member.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
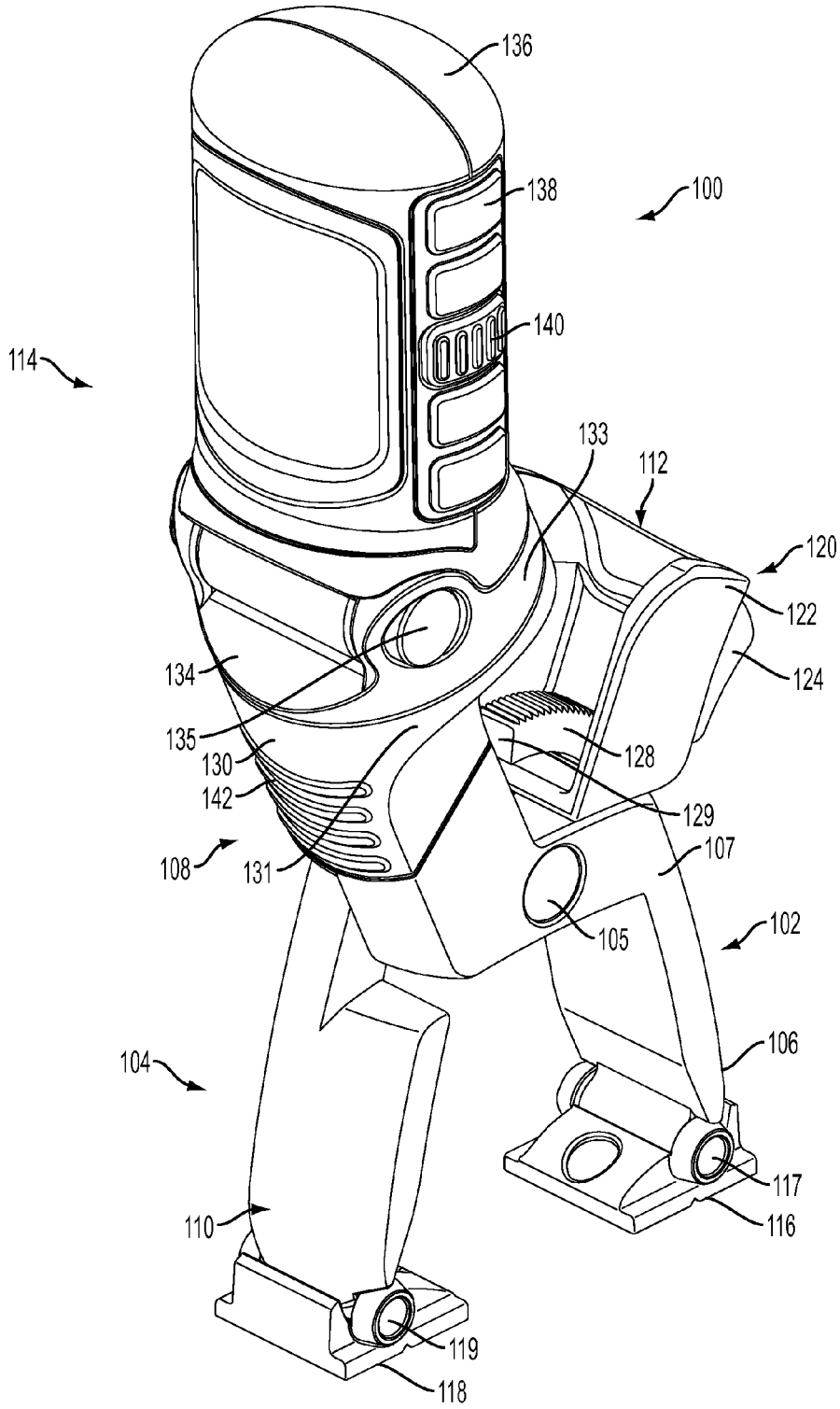
FIG. 1 is a perspective view of a portable work light clamp system in accordance with the inventive arrangements.
Figure 2:
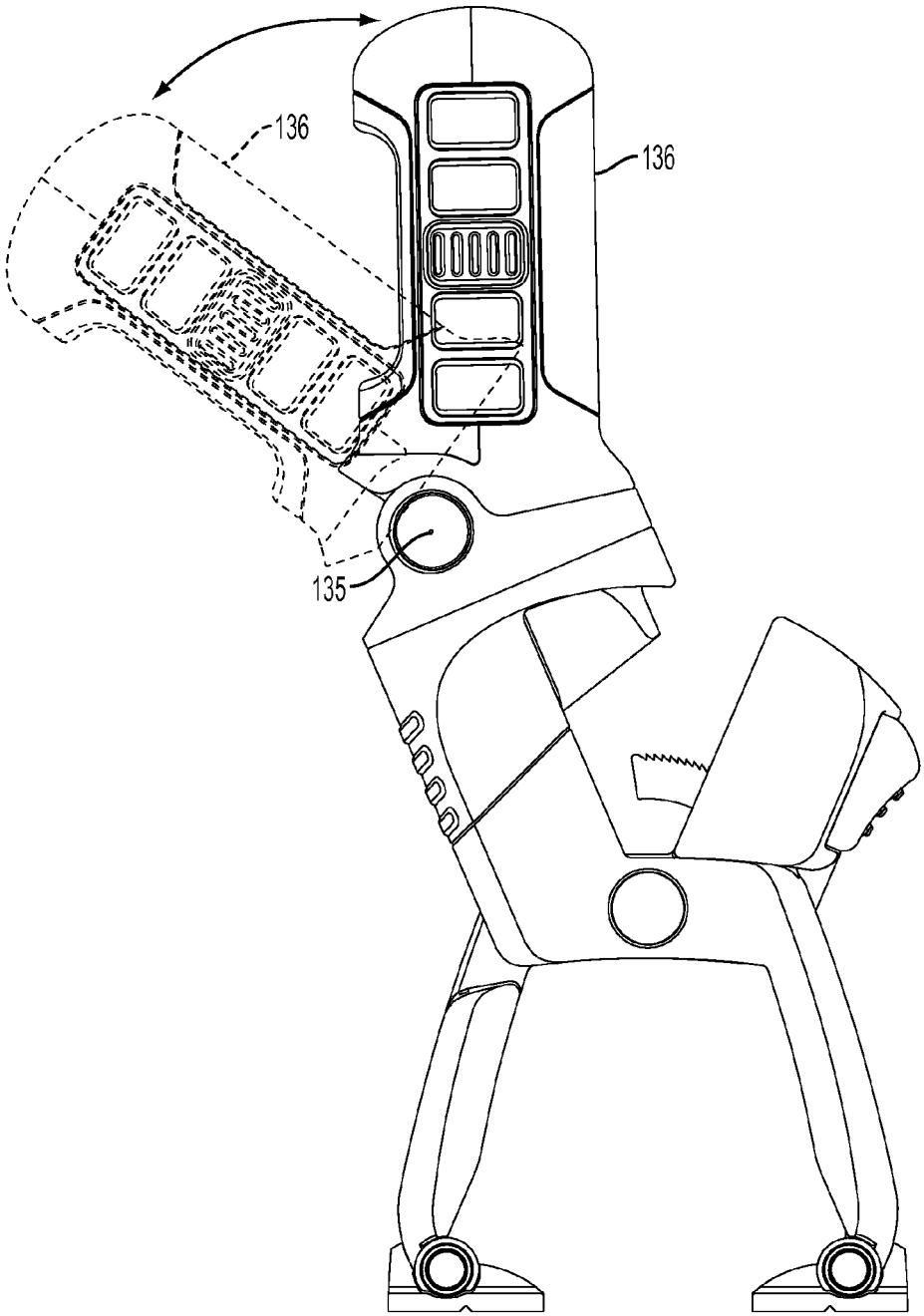
FIG. 2 is a side view of a portable work light clamp system in an open position in accordance with the inventive arrangements.
Figure 3:
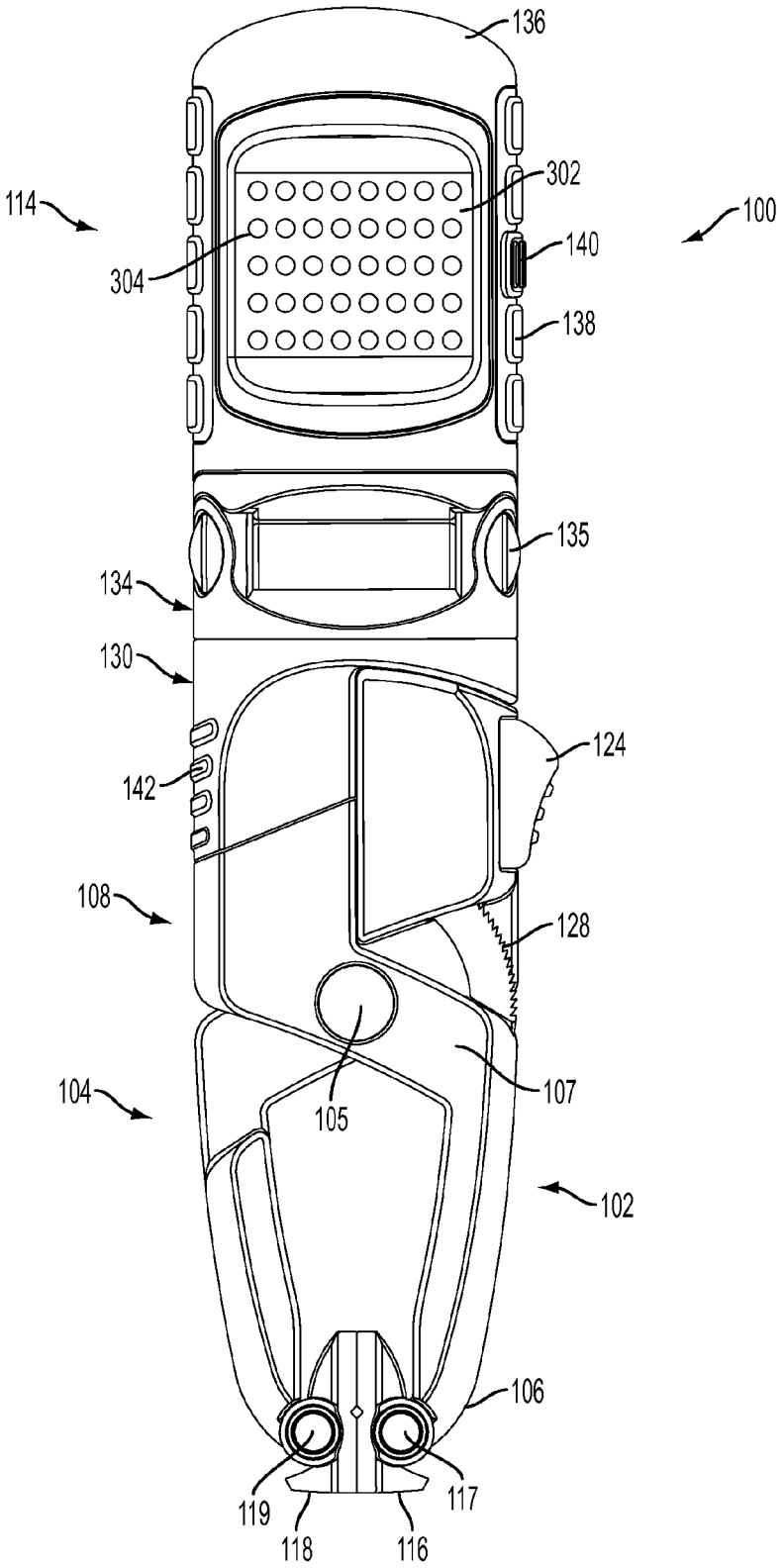
FIG. 3 is a front view of a portable work light clamp system in a closed position in accordance with the inventive arrangements.

FIGS. 1-4 illustrate an exemplar work light clamp system 100. The work light clamp system 100 includes a first clamp handle assembly 102 and a second clamp handle assembly 104 pivotally connected by a clamp pivot 105 (e.g., roll pin, bolt, rivet, screw and the like) for pivotal opposed operation (e.g., scissors-like motion). First clamp handle assembly 102 can include a proximal end 106, a mid section 107 and a distal end 108. The proximal end 106 can include a standing/gripping member 116 that is pivotally coupled thereto by jaw pivot 117. Standing/gripping member 116 can be rotated for standing on a work surface as illustrated in FIG. 1. Alternately, as illustrated in FIG. 3, standing/gripping member 116 can be rotated for clamping to a work surface. Mid section 107 includes a clamp bar 128 that forms part of locking assembly 120, which will be discussed in greater detail below. Distal end 108 can include a light assembly 114. Light assembly 114 can include a light housing 136 pivotally coupled to an upper portion of swivel base member 134 (by a light pivot 135) to provide approximately a 50 degree selectable rotation along a horizontal axis of the swivel base member 134. Light housing 136 can include a light grip 138 and a light switch 140, which can power the light on and off. The lower rounded portion 133 of swivel base member 134 is rotatably connected to an upper portion 131 of light base 130 via a swivel connector (not shown) to provide a 360 degree selectable rotation (see circular arrow of FIG. 4) along a vertical axis of the swivel base member 134. Light base 130 can include a light base grip 142 for gripping the light base 130 while positioning the light housing 136. Light base 130 in turn is mounted to a slotted extension member 532 (see FIG. 5) that provides for telescopic extension of the light assembly 114. Slotted extension member includes a slot 537 that runs along the center portion of one side of the slotted extension member 532. Accordingly connector 533 engages slotted extension member 532 to provide for telescopic extension of light assembly 114. In this way, as illustrated in FIG. 5, the light assembly 514, including the light base 530 can extend away from the clamp pivot 505 along a longitudinal axis of the distal end 508 of the first claim handle assembly 502, while the distal end 512 of the second claim handle assembly 504 remains stationary along a longitudinal axis of the distal end 512 of the second clamp assembly 512. The swivel base member 134 advantageously provides for a work light clamp system 100 that can be selectively and easily positioned and secured for more unique or specialized lighting applications.

Similar to first clamp handle assembly 102, second clamp handle assembly 104 can include a proximal end 110 and a distal end 112. The proximal end 110 can include a standing/gripping member 118 that is pivotally coupled thereto by jaw pivot 119. Distal end 112 can include a locking assembly 120. Locking assembly 120 can include a locking assembly housing 122 coupled to the distal end 112 of the second clamp handle assembly 104 and a trigger assembly 124 mounted in the locking assembly housing 122 the engages the clamp bar 128 which is mounted or coupled to the mid section 107 of the first clamp handle assembly 102 to provide for opening and closing of the clamp assembly. In embodiments as illustrated in FIGS. 1 and 2, clamp bar 128 can have an arcuate shape with a set of teeth for engaging trigger assembly 124 to provide for controlled partial and full opening and/or closing of the clamp assembly. A free end 129 of clamp bar 128 can extend unhindered through or adjacent to the locking assembly housing 122, allowing free relative movement of clamp handle assemblies 102, 104.

Figure 4:
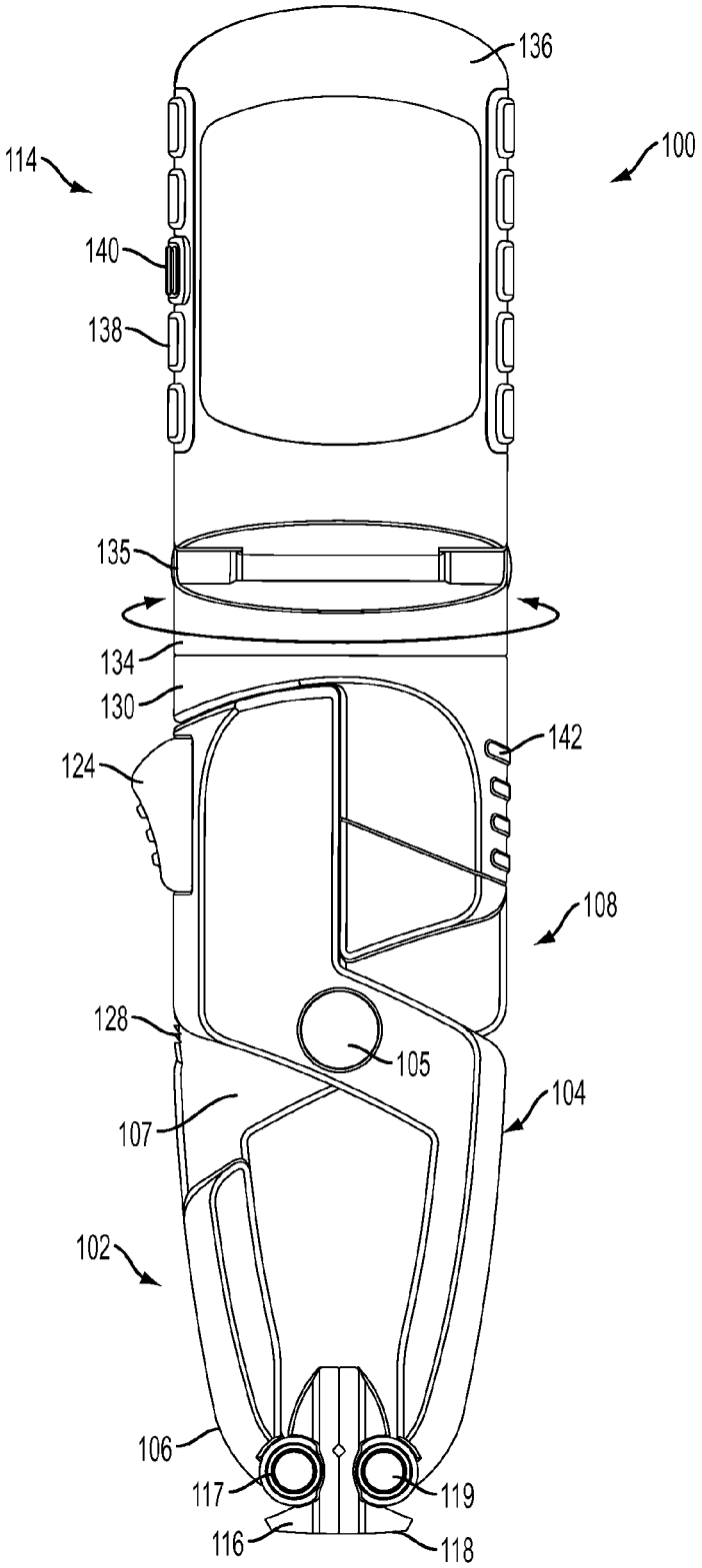
FIG. 4 is a rear view of a portable work light clamp system in a closed position in accordance with the inventive arrangements.
Figure 5:
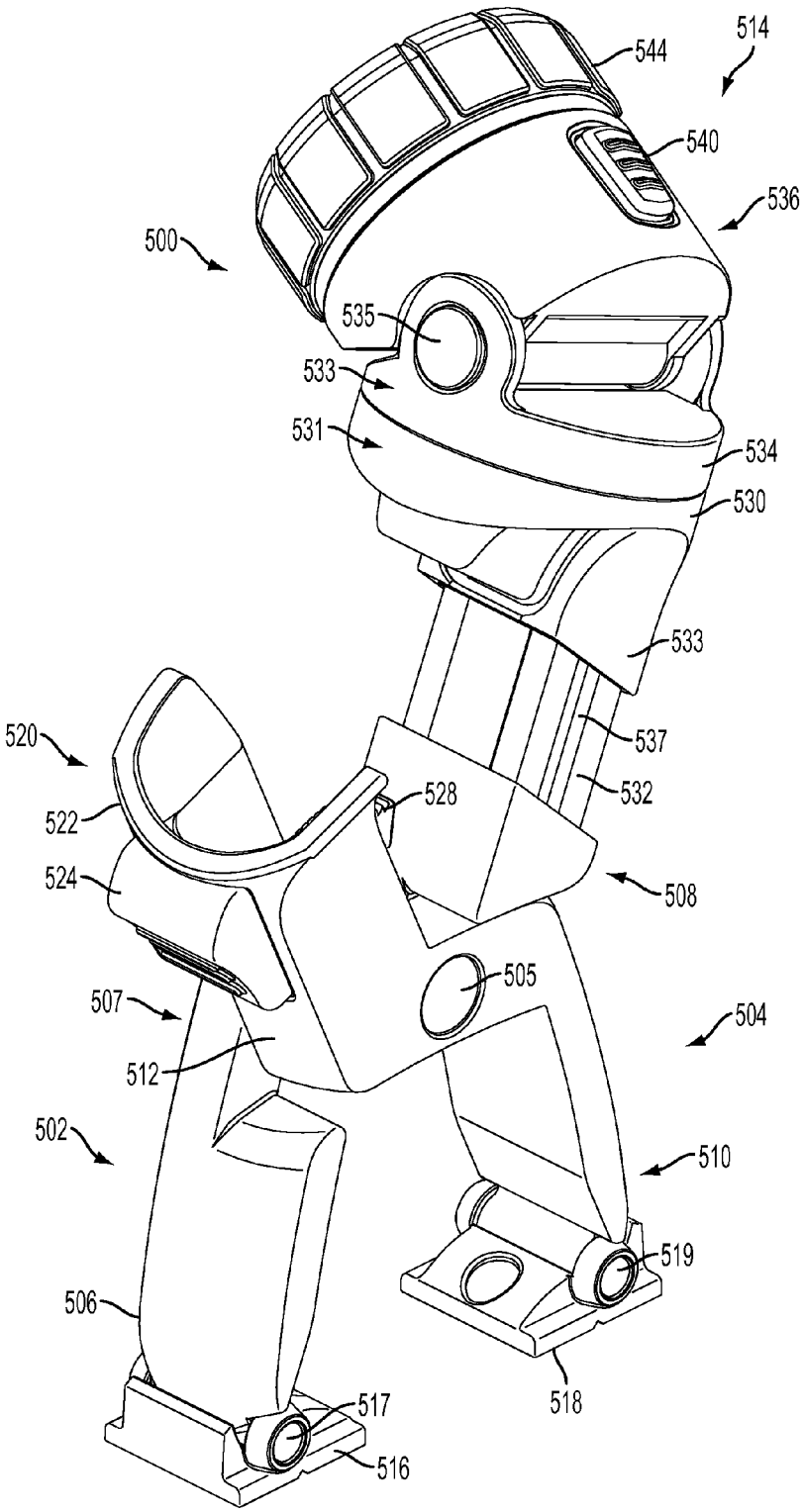
FIG. 5 is a perspective view of a portable work light clamp system where the light assembly is fully extended in accordance with the inventive arrangements.

Referring to FIGS. 3 and 4, light housing 136 can be substantially rectangular in shape and include a lens 302 and a set of LEDs 304 which provide an illumination source. Many types of illumination sources so capable are known in the art, and any such illumination sources (e.g., a halogen bulb or the like) so capable is acceptable for use with the light housing 136.

FIG. 5 illustrates a rear perspective view of an exemplar work light clamp system 500 having a round shaped light housing. Similar to work light clamp system 100 of FIG. 1, work light clamp system 500 includes a first clamp handle assembly 502 and a second clamp handle assembly 504 pivotally connected by a clamp pivot 505 (e.g., roll pin, bolt, rivet, screw and the like) for pivotal opposed operation (e.g., scissors-like motion). First clamp handle assembly 502 can include a proximal end 506, a mid section (not shown) and a distal end 508. The proximal end 506 can include a standing/gripping member 516 that is pivotally coupled thereto by jaw pivot 517. Standing/gripping member 516 can be rotated for standing on a work surface as illustrated in FIG. 5. Alternately, and similar to that illustrated in FIG. 3, standing/gripping member 516 can be rotated for clamping to a work surface. Mid section includes a clamp bar 528 that forms part of locking assembly 520. Distal end 508 can include a light assembly 514. Light assembly 514 can include a light housing 536 having a round shape that can be pivotally coupled to a swivel base member 534 (by a light pivot 535) to provide approximately a 50 degree range of rotation along a horizontal axis of the swivel base member 534. The light housing 536 can include a light grip 544 and a light switch 540, which can power the light on and off. The swivel base member 534 is rotatably connected to light base 530 via a lower portion 533 of the swivel base member 534 and an upper portion 531 of the light base 530 connected via a swivel connector (not shown) to provide a 360 degree rotation along a vertical axis of the swivel base member 534. Light base 530 in turn is mounted by a connector 533 (e.g., a roll pin or the like) to a slotted extension member 532 that provides for telescopic extension of the light assembly 514. In this way, the light assembly 514, including the light base 530 can extend away from the clamp pivot 505 along a longitudinal axis of the distal end 508 of the first claim handle assembly 502, while the distal end 512 of the second claim handle assembly 504 remains stationary along a longitudinal axis of the distal end 512 of the second clamp assembly 512. The swivel base member 534 and extension member 532 advantageously provides for a work light clamp system 500 that can be selectively and easily positioned and secured for more unique or specialized lighting applications.

Similar to first clamp handle assembly 502, second clamp handle assembly 504 can include a proximal end 510 and a distal end 512. The proximal end 510 can include a standing/gripping member 518 that is pivotally coupled thereto by jaw pivot 519. Distal end 512 can include a locking assembly 520. Locking assembly 520 can include a locking assembly housing 522 coupled to the distal end 512 of the second clamp handle assembly 504 and a trigger assembly 524 mounted in the locking assembly housing 522 the engages the clamp bar 528 which is mounted or coupled to the mid section 507 of the first clamp handle assembly 502 to provide for opening and closing of the clamp assembly. Similar to the embodiments illustrated in FIGS. 1 and 2, clamp bar 528 can have an arcuate shape with a set of teeth for engaging trigger assembly 124 to provide for controlled partial and full opening or closing of the clamp assembly.

In operation, work light clamp system 100 can be deployed to stand on a work surface by rotating standing/gripping members 116, 118 to a substantially 85 degree angle with respect to the respective axes of the proximal end portions of first and second clamp handle assembly 102, 104. Alternatively, work light clamp system 100 can be deployed to clamp to a work surface by rotating standing/gripping members 116, 118 to a substantially zero degree angle (i.e., parallel position) with respect to the respective axes of the proximal end portions of first and second clamp handle assembly 102, 104. In this operative position, the surface contact sides of the standing/gripping members 116, 118 can grip a work surface. In both operations, gripping and/or standing, the light assembly 114 can be adjusted in three direction directions or along three direction axes. For example, in a first adjustment, light assembly 114 can be rotated from zero to about 50 degrees along a horizontal axis of the swivel base member 134. In a second adjustment, light assembly 114 can be rotated from zero to about 360 degrees along a vertical axis of the swivel base member 134. In a third adjustment, light assembly 114 can be telescopically extended along a vertical direction from the clamp assembly via a slotted extension member 532 that provides for telescopic extension of the light assembly 114.

The invention has been described with respect to certain preferred embodiments, but the invention is not limited only to the particular constructions disclosed and shown in the drawings as examples, and also comprises the subject matter and such reasonable modifications or equivalents as are encompassed within the scope of the appended claims.

What is claimed is:

1. A portable work light clamp system, the system comprising:

a first clamp handle assembly having a proximal end, a mid section and a distal end;

a first gripping member rotatably coupled to the proximal end of the first clamp handle assembly;

a second clamp handle assembly having a proximal end and a distal end;

a second gripping member rotatably coupled to the proximal end of the second clamp handle assembly;

the first clamp handle assembly and the second clamp handle assembly pivotally connected by a clamp pivot for pivotal opposed operation;

a light assembly coupled to the distal end of only the first clamp handle assembly, wherein the light assembly includes a swivel base member and a light housing pivotally coupled to an upper portion of the swivel base member by a light pivot, the light pivot enabling the light housing to selectively pivot 50 degrees about a longitudinal axis of the light pivot, the swivel base member having a rounded lower portion that includes a flat bottom that is coupled to a rounded upper portion of a light base; and, the light base coupled to the swivel base member, the swivel base member having a rounded upper portion that includes a flat top that is coupled to the round lower portion of the swivel base member and rotatable relative to the light base by a swivel connector, the swivel connector enabling the swivel base member to selectively rotate 360 degrees around a longitudinal axis of the light base, wherein the first gripping member and also the second gripping member rotate from a first position for gripping an object to a second position for standing on a work surface.

2. The portable work light clamp system according to claim 1, further comprising:

a slotted extension member having a length, the slotted extension member coupled to the distal end of only the first clamp handle assembly and coupled to a light base by a connector, the light base slidably extend along the length of the slotted extension member.

3. The portable work light clamp system according to claim 1, further comprising:

a locking assembly, the locking assembly including a locking assembly housing coupled to the distal end of the second clamp handle assembly and a trigger assembly mounted in the locking assembly housing, the trigger assembly configured to engage a clamp bar coupled to the mid section of the first clamp handle assembly to provide for the pivotal opposed operation of the first clamp handle assembly and the second clamp handle assembly.

4. The portable work light clamp system according to claim 3, wherein the clamp bar has an arcuate shape with a set of teeth.

5. A portable work light clamp system, the system comprising:

a first clamp handle assembly having a proximal end, a mid section and a distal end;

a first gripping member rotatably coupled to the proximal end of the first clamp handle assembly;

a second clamp handle assembly having a proximal end and a distal end;

a second gripping member rotatably coupled to the proximal end of the second clamp handle assembly;

the first clamp handle assembly and the second clamp handle assembly pivotally connected by a clamp pivot for pivotal opposed operation;

a light assembly coupled to the distal end of only the first clamp handle assembly, wherein the light assembly includes a swivel base member and a light housing pivotally coupled to an upper portion of the swivel base member by a light pivot, the light pivot enabling the light housing to selectively pivot 50 degrees about a longitudinal axis of the light pivot, the swivel base member having a rounded lower portion that includes a flat bottom that is coupled to a rounded upper portion of a light base;

the light base coupled to the swivel base member, the swivel base member having a flat top that is coupled to the round lower portion of the swivel base member by a swivel connector, the swivel connector enabling the swivel base member to selectively rotate 360 degrees around a longitudinal axis of the light base;

a slotted extension member having a length, the slotted extension member coupled to the distal end of only the first clamp handle assembly and coupled to the light base by a connector, the light base to slidably extend along the length of the slotted extension member; and wherein the first gripping member and also the second gripping member rotate from a first position for gripping an object to a second position for standing on a work surface.

6. The portable work light clamp system according to claim 2, wherein the light base slidably extending along the length of the slotted extension comprises the light base slidably extending away from the clamp pivot along a longitudinal axis of the distal end of first clamp handle assembly while the distal end of the second clamp handle assembly remains stationary along a longitudinal axis of the distal end of the second clamp handle assembly.

7. The portable work light clamp system according to claim 5, wherein the light base slidably extending along the length of the slotted extension comprises the light base slidably extending away from the clamp pivot along a longitudinal axis of the distal end of first clamp handle assembly while the distal end of the second clamp handle assembly remains stationary along a longitudinal axis of the distal end of the second clamp handle assembly.

* * * * *